United States Patent [19]

Karydas et al.

[11] Patent Number: 4,997,580

[45] **Date of Patent: * Mar. 5, 1991**

[54] USE OF ORGANIC FLUOROCHEMICAL COMPOUNDS WITH OLEOPHOBIC AND HYDROPHOBIC GROUPS IN CRUDE OILS AS ANTIDEPOSITION AGENTS, AND COMPOSITIONS THEREOF

[75] Inventors: Athanasios Karydas, Brooklyn, N.Y.; Thomas W. Cooke, Decatur, Ill.; Robert A. Falk, New City, N.Y.

[73] Assignee: Ciba-Geigy Corporation, Ardsley, N.Y.

[ * ] Notice: The portion of the term of this patent subsequent to Aug. 30, 2005 has been disclaimed.

[21] Appl. No.: 382,008

[22] Filed: Jul. 17, 1989

Related U.S. Application Data

[63] Continuation of Ser. No. 145,433, Jan. 19, 1988, abandoned, which is a continuation-in-part of Ser. No. 892,212, Jul. 31, 1986, Pat. No. 4,767,545.

[51] Int. Cl.[5] ..... F17D 1/08; E21B 43/12

[52] U.S. Cl. ..... 252/8.3; 252/8.551; 252/8.552; 166/304; 137/13

[58] Field of Search ..... 252/8.551, 8.552, 8.3; 137/13; 166/304

[56] References Cited

U.S. PATENT DOCUMENTS

| | | | |
|---|---|---|---|
| 2,364,222 | 12/1944 | Kaufman | 252/8.552 |
| 3,346,612 | 10/1967 | Hansen . | |
| 3,828,098 | 8/1974 | Gilleo et al. . | |
| 3,957,659 | 5/1976 | Van De Kraats et al. | 252/8.3 |
| 4,014,171 | 8/1978 | Stechmeyer | 252/8.3 |
| 4,127,140 | 11/1978 | Sweeney | 137/13 |
| 4,425,242 | 1/1984 | Penny et al. | 252/8.551 |
| 4,432,882 | 2/1984 | Raynolds et al. | 252/8.551 |
| 4,460,791 | 7/1984 | Cooke | 568/45 |
| 4,767,545 | 8/1988 | Karydas et al. | 252/8.3 |
| 4,769,160 | 9/1988 | Karydas | 252/8.551 |
| 4,876,018 | 10/1989 | Karydas | 252/8.551 |
| 4,880,565 | 11/1989 | Rose et al. | 137/13 X |
| 4,921,619 | 5/1990 | Karydas | 252/8.551 X |

*Primary Examiner*—Robert L. Stoll
*Assistant Examiner*—Gary L. Geist
*Attorney, Agent, or Firm*—JoAnn Villamizar

[57] ABSTRACT

A method of inhibiting the deposition of paraffin wax, asphaltene, or mixtures thereof in a crude oil contaminated with paraffin wax, asphaltene, or mixtures thereof and susceptible to such depositions comprising the step of incorporating into said crude oil an effective deposition inhibiting amount of an oil soluble organic compound having at least one oleophobic and hydrophobic fluoroaliphatic group, and antideposition stabilized crude oil compositions containing said compound, are disclosed.

6 Claims, No Drawings

USE OF ORGANIC FLUOROCHEMICAL COMPOUNDS WITH OLEOPHOBIC AND HYDROPHOBIC GROUPS IN CRUDE OILS AS ANTIDEPOSITION AGENTS, AND COMPOSITIONS THEREOF

This application is a continuation of application Ser. No. 145,433, filed 01/19/88 now abandoned which is a Continuation-in-part of Ser. No. 892,212 filed 07/31/86 now U.S. Pat. No. 4,767,545.

BACKGROUND OF THE INVENTION

The present invention relates to an improved method of transporting hydrocarbon crude oils containing paraffin wax, asphaltenes, or mixtures thereof, and compositions for use in such method. More particularly, the present invention relates to the introduction into low water hydrocarbon crude oils contaminated with paraffin wax, asphaltenes, or mixtures thereof, and which oils are normally susceptible to deposition by such contaminants, of an effective deposition inhibiting amount of an oil soluble organic compound having at least one oleophobic and hydrophobic fluoroaliphatic group. The present invention also relates to crude oil compositions contaminated with deposition susceptible paraffins, asphaltenes, or mixtures thereof, and containing an effective deposition inhibiting amount of such oleophobic and hydrophobic fluoroaliphatic group containing oil soluble organic compounds.

Crude oils are complex mixtures comprising hydrocarbons of widely varying molecular weights, i.e. from the very simple low molecular weight species including methane, propane, octane and the like to those complex structures whose molecular weights approach 100,000. In addition, sulfur, oxygen and nitrogen containing compounds may characteristically be present. Further, the hydrocarbyl constituents may comprise saturated and unsaturated aliphatic species and those having aromatic character.

By a variety of fractionation procedures crude oils can be separated into various classes, the most common of which is boiling range. The mixtures which are in the lower boiling ranges generally consist of materials of relatively simple structures. The mixtures which are in the high boiling point ranges comprise substances which, with the exception of paraffins, are so complex that broad terms are applied to them such as resins and asphaltenes. Resins are poorly characterized but are known to be highly aromatic in character and are generally thought to be high molecular weight polynuclear aromatic hydrocarbons which melt over a wide, elevated temperature range. Asphaltenes are even more complex chemically—some of which suffer thermal decomposition before melting. They are high molecular weight polymers in colloidal suspension. Resins and asphaltenes characteristically contain sulfur, nitrogen or oxygen-containing compounds. Paraffins are linear or branched chain hydrocarbons in the range of $C_{18}H_{38}$ to $C_{60}H_{122}$ and are usually waxy solids with widely varying melting points. Paraffins generally have limited, temperature-dependent, solubility in produced crude oils. This poor solubility creates a considerable problem for the oil producer.

The problem is aggravated by the very nature of oil production, as crude oil is generally removed from a high pressure or high temperature environment and then is subjected to atmospheric pressure and low temperatures.

The paraffin is usually soluble in crude petroleum under "down-hole" conditions. Ordinarily, as the petroleum is brought to the surface, its temperature is reduced and the crude is subjected to a diminished pressure. As the crude leaves the wellhead at the reduced pressure, dissolved gases, which act as natural solubilizers for paraffin, tend to come out of solution. These two factors, the decrease in temperature and the loss of dissolved gases, decrease the ability of the remaining crude to keep the paraffin solution. As a result, wax crystals may precipitate on any appropriate surface.

When the petroleum waxes precipitate, they cause a myriad of problems for the oil producer. The precipitated waxy solids can create flow restrictions by depositing or accumulating downhole on tubing, rods, and sub-surface pumps; and above ground in valves, piping, separators, and storage tanks. These troublesome deposits are combinations of an array of molecular weight hydrocarbons and adsorbed impurities.

Since any given crude always contains a mixture of alkanes (saturated hydrocarbons) of different molecular weights, different solubilities, and different melting points, the associated paraffin deposits will vary in content depending on the deposition conditions. The major influences on the quantity of the deposit, as well as its composition, are the bulk oil and pipe surface temperatures, the temperature gradient between the oil and surface, and the flow rate of the oil.

Important factors determining the amount and rate of deposition of wax include the pipe surface and bulk oil temperatures relative to the cloud point of the crude. The cloud point of a crude is generally defined as the temperature at which wax crystallization begins. If the temperature of both the pipe and the oil flowing through it are above the cloud point, little or no waxy deposition will occur. If, however, the temperature of the inside surface of the pipe falls below the cloud point of the oil and the bulk of the flowing crude oil is at a higher temperature, wax will characteristically be deposited on the pipe surface. If the pipe surface is only slightly cooler than the cloud point of the oil, and the oil is much warmer, a lesser amount of waxy deposit will form, generally composed of the highest molecular weights, highest melting, hardest waxes in the crude. If the pipe surface temperature is much lower than the bulk oil temperature, a greater quantity of softer, lower melting deposit will usually accumulate.

If the gradient is reversed and the pipe wall is warmer than the oil flowing past, little or no deposition will occur, even if the temperature of the pipe and the oil are both below the oil's cloud point.

The flow rate of a crude past a deposition surface may also influence the composition of the deposits. A high flow rate tends to selectively remove the lower melting, softer fractions from the growing deposit, resulting in the formation of a hard dense deposit of high melting wax. A very low flow rate allows the inclusion of low melting, softer waxes and even of oil fractions in the waxy deposits. The net deposit is generally a very soft, low melting deposit.

Because of the diverse conditions that exist in a production system, it is not uncommon for several of the conditions for deposition to be present in the same system. This can result in different types of deposits forming in different locations within the same system. Soft, low melting deposits may form downhole while hard, higher melting deposits may form downstream of a choke or a valve in the pipeline leaving the well.

There are many methods of handling paraffin deposition. These can be divided into 3 categories: mechanical, thermal, and chemical.

A widely used mechanical treatment involves running a scraper that mechanically cuts the deposit from the tubing. Wirelining the tubing and "pigging" the flowlines are two examples.

Thermal treatment normally consists of minimizing heat losses and the addition of external heat to the system. Insulation of flowlines and maintaining a higher pressure in the flow lines that minimizes cooling through dissolved gas expansion are two examples of minimizing heat losses. Procedures such as steaming the flowlines, installing bottomhole heaters, and circulation of hot oil or hot water are examples of the application of heat in an effort to melt or increase the solubility of the deposit.

Chemical control generally falls into one of two classes: (1) using a solvent to dissolve the deposit once it has formed and (2) inhibiting wax crystal growth or inhibiting its adherence to the tubing wall.

Solvents used for dissolving paraffin deposits generally have a high aromatic content. A variety of solvents, including relatively low wax crude oils, are heated when used to increase the wax solution capacity of the solvents. Unfortunately, this procedure can be prohibitively expensive, particularly where such solvents are not readily available.

Typical paraffin inhibitors include certain known copolymers capable of crystal distortion or modification during the wax deposition process. Because the use of such copolymers involve a cocrystallization mechanism, it is necessary to have the copolymer in solution above the cloud-point temperature of the crude. This cocrystallization mechanism prevents or interferes with the molecular diffusion mechanism of deposition, and is believed to modify the crystal structure of the precipitated waxes into small, highly branched structures with low cohesive properties. Three popular crystal modifiers are copolymers in these groups: (1) Group A—copolymers of ethylene vinyl acetate, (2) Group B—copolymers of $C_{12}$ through $C_{30}$ methacrylates, and (3) Group C—copolymers of olefin/maleic anhydride esters.

Products of this type are commercially available under the trade names Shellswim®, Waxstock® and Marchon®. Some are described in U.S. Pat. No. 3,776,247 and British patents Nos. 1,161,188 and 1,154,966. However, not all waxy crudes are beneficially affected by treatment with such substances, possible because the ability of any particular conventional popular copolymer to cocrystallize will vary depending on the particular crude oil treated.

Asphaltenes may also precipitate from crude oils, likewise creating a myriad of problems for the oil producer.

Asphaltenes are aromatic-base hydrocarbons of amorphous structure. They are present in crude oils in the form of colloidally dispersed particles. The central part of the asphaltene micelle generally consists of high molecular weight compounds surrounded and peptized by lower weight neutral resins and aromatic hydrocarbons.

Any action of chemical, electrical or mechanical nature that depeptizes the asphaltene micelle may lead to flocculation and precipitation of the asphaltenes from the crude oil. The addition of low-surface-tension liquids—i.e. below 24 mN/m [24 dyne/cm] at 25° C., such as gasoline, pentane, hexane, petroleum naphtha, etc. may precipitate asphaltenes. The addition of HCl during acidizing also tends to cause the formation of precipitated asphalticacid sludges. The flow of crude oil through porous media may also result in the precipitation of asphaltenes because of the neutralization of their charge by the streaming potential.

Asphaltene deposits are characteristically hard, brittle, dark black, dry solids, similar in appearance to coal and other bitumens. These deposits are very difficult to remove from a system because typical thermal methods of hot oil or water treatment are generally totally ineffective. The deposition of these materials also constricts or blocks the passage of crude oil causing reduced efficiency of production. Prevention or removal can be attempted chemically through the use of aromatic solvents, solvent accelerators, or the resinous components of crudes. Here again, such procedures can be prohibitively expensive and may not be effective.

Other approaches that have been suggested to inhibit or prevent asphaltene and paraffin deposits include the use of aqueous surfactant solutions to form low viscosity oil-in-water emulsions as shown in U.S. Pat. Nos. 3,943,954, 4,265,264, 4,429,554 and 4,239,052. Such emulsions generally contain a rather high percentage of water, for example 10–40% water, which must be removed. Removal is not always easy and yields large volumes of water contaminated with oil. High treating temperatures are required for separation of the water and this results in additional expenditures. Also, corrosion problems, freezing problems, and emulsion inversion into highly viscous water-in-oil emulsions problems may be associated with such aqueous emulsions, depending upon the nature of the field conditions, local climate, and the like.

Inhibition of paraffin and asphaltene deposition by crude oils is achieved by the addition to such oils of an effective amount of paraffin and asphaltene deposition inhibitors which are oil soluble organic compounds having at least one oleophobic and hydrophobic fluoroaliphatic group.

SUMMARY OF THE INVENTION

One embodiment of the present invention relates to a method of inhibiting paraffin wax or asphaltene deposition from a low water hydrocarbon crude oil contaminated with such paraffin wax or asphaltene or mixtures thereof by contacting said oil with an effective deposition inhibiting amount of an oil soluble organic compound having at least one oleophobic and hydrophobic fluoroaliphatic group, said group having between about 4 to about 20 carbon atoms.

Preferably, the fluoroaliphatic group-containing oil soluble organic compound is added to the pipeline or well bore of the wax or asphaltene contaminated hydrocarbon crude oil. In order to insure rapid and efficient dissolution and dispersion of the fluoroaliphatic oil soluble organic compound, the deposition inhibitor may conveniently be added to the crude oil as a solution or semiliquid by dilution of the deposition inhibitor in a liquid organic oil soluble carrier.

Advantageously, useful fluoroaliphatic oil soluble organic compounds are those exhibiting a solubility in the crude oil to be treated of at least 10 ppm by weight at 80° C.; which are sufficiently oleophobic such that a steel coupon treated with the fluoroaliphatic compound gives a contact angle with hexadecane of fifteen degrees or more; and wherein the fluorine content is generally between about 1 and about 70 weight percent of the fluoroaliphatic compound. Useful guides in selecting highly preferred fluoroaliphatic compounds useful in deposition inhibition are found in the laboratory screening techniques for paraffin and asphaltene deposition inhibition tests described hereinafter.

An alternate embodiment of the present invention relates to anti-deposition stabilized crude oil compositions containing in the dissolved and dispersed state an effective wax and asphaltene deposition amount of the fluoroaliphatic oil soluble compound.

These and other objects of the present invention are apparent from the following specific disclosures.

DETAILED DESCRIPTION OF THE INVENTION

Generally, suitable oil soluble organic compounds containing at least one oleophobic and hydrophobic fluoroaliphatic group can be represented by the formula $$[(R_f)_nR']_mZ \qquad (I)$$

wherein $R_f$ is an inert, stable, oleophobic and hydrophobic fluoroaliphatic group having about 4 to about 20 carbon atoms;

n is an integer from 1 to 3;

R' is a direct bond or an inorganic linking group having a valency of n+1 and is covalently bonded to both $R_f$ and Z;

m is an integer of from 1 to about 5000; and

Z is a hydrocarbyl containing residue having a valency of m and being sufficiently oleophilic so as to impart an oil solubility to said compounds of at least 10 parts by weight per million parts of hydrocarbon crude oil.

Suitable $R_f$ groups include straight or branched chain perfluoroalkyl having 4 to 20 carbon atoms, perfluoroalkoxy substituted perfluoroalkyl having a total of 4 to 20 carbon atoms, omega-hydro perfluoroalkyl of 4 to 20 carbon atoms, or perfluoroalkenyl of 4 to 20 carbon atoms. If desired, the $R_f$ group may be a mixture of such moieties.

The integer n is preferably 1 or 2.

Where n is 1, R' may be a direct bond or a divalent organic linking group. The nature of the divalent organic linking group R', when present, is not critical as long as it performs the essential function of bonding the fluoroaliphatic group, $R_f$, to the oleophilic organic radical Z.

In one sub-embodiment, R' is an organic divalent linking group which covalently bonds the $R_f$ group to the group Z.

Thus, R' may, for example, be a divalent group, R°, selected from the following:

-$C_1$-$C_8$ alkylene-,
-phenylene-,
-$C_1$-$C_8$ alkylene-$R_1$-$C_1$-$C_8$ alkylene-,
-$C_3$-$C_8$ alkylene-$R_1$-, -$C_{1-2}$alkylene-$R_1$''-
-$R_1$-$C_1$-$C_8$ alkylene-,
-$R_1$-$C_1$-$C_8$ alkylene-$R_1$'-.
-$R_1$-,
-$R_1$-phenylene-,
-$R_1$-phenylene-$R_1$-,
-$R_1$-phenylene-$C_1$-$C_8$ alkylene-, or
-phenylene-$R_1$-, Wherein, in each case, said alkylene and phenylene are independently unsubstituted or substituted by hydroxy, halo, nitro, carboxy, $C_1$-$C_6$ alkoxy, amino, $C_1$-$C_6$ alkanoyl, $C_1$-$C_6$ carbalkoxy, $C_1$-$C_6$ alkanoyloxy or $C_1$-$C_6$ alkanoylamino. The alkylene moiety may be straight or branched chain or contain cyclic alkylene moieites, such as cycloalkylene or norbornylene.

$R_1$ and $R_1$' independently represent:
-N($R_2$)-, -CO-, -N($R_2$)CO-, -CON($R_2$)-,
-N($R_2$)COO-, -OOCN($R_2$)-, -S-,
-SO-, -$SO_2$-, -N($R_2$)$SC_2$-, -$SO_2$N($R_2$)-,
-N($R_2$)CON($R_2$)-, -COO-, -OOC-,
-$SO_2$O-, -O$SO_2$-, -O$SO_2$O-, -OCOO-,

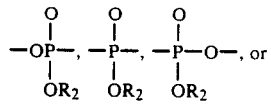

-O-, and $R_1$'' is selected from -$NR_2$-, -CO-, -$NR_2$CO-, -$CONR_2$-, -$NR_2$COO-, -OOCN($R_2$)-, -S-, -SO-, -$SO_2$-, -$NR_2SO_2$-,
-$SO_2NR_2$-, -$NR_2CONR_2$, -COO-, -$SO_2$O-, -O$SO_2$-, -O$SO_2$O-,

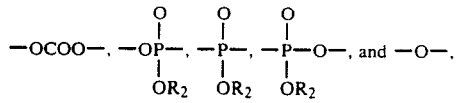

where $R_2$ is hydrogen, $C_{1-6}$ alkyl or $C_{1-6}$ alkyl substituted by: $C_{1-6}$ alkoxy, halo, hydroxy, carboxy, $C_{1-6}$ carbalkoxy, $C_{1-6}$ alkanoyloxy, or $C_{1-6}$ alkanoylamino. A preferred embodiment is where $R_1$ and $R_1$' are selected from the same group as $R_1$''. A highly preferred embodiment is when $R_1$'' does not contain a carbonyl group. Also, if desired, the amino group —N($R_2$)—, above, may be in quaternized form, for example of the formula

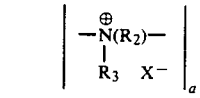

wherein a is 1, $R_3$ is hydrogen or $C_1$-$C_6$ alkyl which is unsubstituted or substituted by hydroxy, $C_1$-$C_6$ alkoxy, $C_1$-$C_6$ alkanoyloxy or $C_1$-$C_6$ carbalkoxy and x is an anion, such as halo, sulfato, lower alkylsulfato such as methylsulfato, lower alkyl-sulfonyloxy such as methylsulfonyloxy, lower alkanoyloxy such as acetoxy or the like.

As an alternate sub-embodiment, R', while being covalently bonded to both $R_f$ and Z may contain an ionic bridging group as an integral part of the chain linking $R_f$ to Z.

Thus, for example, R' may be selected from the following:

$$\left(R_a'\right)_sQ^{\oplus\ominus}T\left(R_b'\right)_t \quad \text{or} \quad \left(R_a'\right)_sT^{\ominus\oplus}Q\left(R_b'\right)_t$$

where $R_a$' is -$C_1$-$C_8$ alkylene-, -phenylene-, -$C_1$-$C_8$ alkylene-$R_1$-$C_1$-$C_8$ alkylene-, -$R_1$-$C_1$-$C_8$ alkylene-, -$R_3$-phenylene- or $R_1$-phenylene-$C_1$-$C_8$ alkylene-;

$R_b'$ is -$C_1$-$C_8$ alkylene, -phenylene-, -$C_1$-$C_8$ alkylene-$R_1$-$C_1$-$C_8$ alkylene-, -$C_1$-$C_8$ alkylene-$R_1$-, -phenylene-$R_1$- or -$C_1$-$C_8$ alkylene-phenylene-$R_1$-; s and t are independently 0 or 1; T is anionic group, $R_f$ is as defined above and Q is a cationic group and wherein said alkylene and phenylene unsubstituted or substituted by hydroxy, halo, nitro, carboxy, $C_1$-$C_6$ alkoxy, amino, $C_1$-$C_6$ alkanoyl, $C_1$-$C_6$ carbalkoxy, $C_1$-$C_6$ alkanoyloxy or $C_1$-$C_6$ alkanoylamino.

Suitable anionic groups for T include carboxy, sulfoxy, sulfato, phosphono, and phenolic hydroxy. Suitable cationic groups for Q include amino and alkylated amino, such as those of the formula

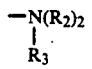

where each $R_2$ and $R_3$ are as defined above.

Where n is 2 and m is 1, R' is an organic trivalent group. Suitable such groups include the trivalent analogs of the above divalent groups, and those of the formula:

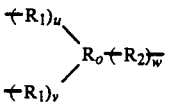

wherein $R_1$ and $R_2$ are defined above; u, v and w are independently 1 to 0 and $R_o$ is alkanetriyl, arenetriyl or aralkanetriyl of up to 18 carbon atoms which may be interrupted by one or more hetero atoms, and as oxygen, sulfur or —N($R_2$)—. Additional trivalent R' groups which may be suitable are those of the formula

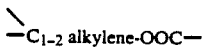

which is unsubstituted or substituted by hydroxy, halo, nitro, carboxy, $C_{1-6}$ alkoxy, amino, $C_{1-6}$ alkanoyl, $C_{1-6}$ carbalkoxy, $C_{1-6}$ alkanoyloxy or $C_{1-6}$ alkanoylamino.

When n is 3 and m is 1, R' is preferably selected from the tetravalent analogs of the above divalent and trivalent groups.

The oleophilic organic radical Z can vary widely and is, in general, not critical, as long as the group performs the essential function of conferring the requisite oil solubility to the compound.

For example, suitable oleophilic organic radicals, when m is 1 include, without limitation, conventional hydrophobic-oleophilic higher alkyl or alkenyl of 6–24 carbon atoms which are unsubstituted or substituted, e.g., by chloro, bromo, alkoxy of up to 18 carbon atoms, nitro, alkanoyl of up to 18 carbon atoms, alkylmercapto of up to 18 carbon atoms, amino, $C_1$-$C_{18}$ alkylamino, or di-$C_1$-$C_{18}$ alkylamino; an aryl group, such as phenyl or naphthyl, the phenyl and naphthyl moiety of which is unsubstituted or substituted by alkyl of up to 20 carbon atoms, alkoxy of up to 20 carbon atoms, alkanoyl of up to 20 carbon atoms, alkanoyloxy of up to 20 carbon atoms or mono- di-alkylamino of up to 20 carbon atoms; mono-or di-$C_6$-$C_{24}$-alkylamino-$C_2$-$C_7$-alkylene; alkoxyalkylene of 4–20 carbon atoms which is unsubstituted or substituted by one or two $C_6$-$C_{24}$ carbalkoxy or $C_6$-$C_{24}$ carbamoyl groups; poly-$C_6$-$C_{24}$alkoxy-higher alkyl or alkenyl of 6–24 carbon atoms; a heterocyclic group such as piperidino, piperazino, azepino, N-pyridinium, morpholino, benztriazolyl, trizinyl, pyrrolidino, furanyl, tetrahydrofuranyl and the like, which are unsubstituted or substituted, e.g., by halo, alkoxy of up to 18 carbon atoms, nitro, alkanoyl of up to 18 carbon atoms, alkylmercapto of up to 18 carbon atoms, amino or alkylamino of up to 18 carbon atoms; poly-$C_2$-$C_3$ alkoxy-phenyl, the phenyl group of which is unsubstituted or substituted by alkyl of up to 20 carbon atoms; a group of the formula —($CH_2CH_2CH_2CH_2O$)$_g$H and g is 2–80; a group of the formula

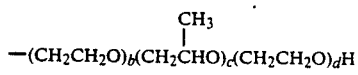

wherein b is 2–40, c is 2–80, and d is 2–40; a group of the formula

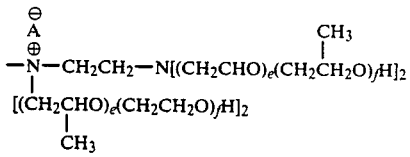

wherein each e is 3–20, and each f is 3–20 and A is an anion; a group of the formula

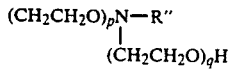

wherein p is 1–15 and q is 1–15 and R'' is alkyl of 6 to 22 carbon atoms or alkanol of 6 to 22 carbon atoms;

or a group of the formula

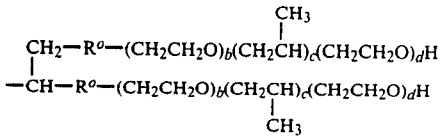

where $R^o$, b, c and d are as defined above.

Also, where m is 2 or 3, Z represents an oleophilic organic divalent or trivalent radical. Suitable such radicals include those wherein Z is an oleophilic di- or trivalent aliphatic, carbocyclic, heterocyclic or aromatic group. For example, when m is 2, Z may represent an oleophilic polyalkyleneoxy containing group, the terminal members of which are covalently bonded to R'; an arylene group, such as phenylene or naphthalene which are unsubstituted or substituted, e.g. by alkyl up to 20 carbon atoms, alkoxy of up to 20 carbon atoms, alkanoyloxy of up to 20 carbon atoms, alkanoylamino of up to 20 carbon atoms, halo, amino or alkylamino of up to 20 carbon atoms, or the like; an alkylene or alkenylene group of up to 20 carbon atoms which is unsubstituted or substituted, e.g. by alkoxy of up to 20 carbon atoms, alkylamino of up to 20 carbon atoms, alkanoyl of up to 20 carbon atoms, alkanoylamino of up to 20 carbon atoms, or alkanoyloxy of up to 20 carbon atoms; a heterocyclic group, such as N,N'-piperazinylene, triazinylene, or the like.

An alternate group of oil soluble compounds according to formula I are those wherein the $R_f$ group is pendant to an oleophilic polymer backbone.

Suitable oleophilic polymer backbones are those derived from condensation polymers and addition polymers.

For example, the group Z may contain condensation units of the formula:

$$(O—R_3—OCONH—D—NHCO)_m$$

wherein $R_3$ is an aliphatic triradical or tetraradical of 2-50 carbon atoms which is covalently bonded to the $(R_f)_nR'$ groups and is selected from the group consisting of branched or straight chain alkylene, alkylenethioalkylene, alkyleneoxyalkylene or alkyleneiminoalkylene; and D, together with the —NHCO groups to which it is attached, is the organic divalent radical of a diisocyanate.

In a preferred subembodiment, D is alkylene of 2 to 16 carbon atoms; cycloaliphatic of 6 to 24 carbon atoms; phenylene that is unsubstituted or substituted by lower alkyl, lower alkoxy or chloro;diphenylene; phenyleneoxyphenyl, phenylene (lower alkylene) phenylene, or naphthylene, where the aromatic ring is otherwise unsubstituted or substituted by lower alkyl, lower alkoxy or chloro. In an alternate embodiment, up to about 85 percent of the $[(R_f)_nR']_mR_3$ groups may be replaced by the biradical of a bis-(2-aminopropyl) ether of a polyethylene oxide; an aliphatic polyol of up to 18 carbon atoms; a di- or polyalkoxylated aliphatic or aromatic tertiary amine of up to 18 carbon atoms; a lower alkylene polyether; or a hydroxyterminated polyester having a hydroxyl number from 40 to 500.

Suitable preferred condensation polymers and their preparations are described, inter alia, in U.S. Pat. Nos. 3,935,277, 4,001,305, 4,046,994 and 4,054,592.

Suitable oleophilic polymer backbones derived from addition polymers comprising the group Z include those wherein up to about 5000 groups of the formula (Rf)nR'- are attached to an oleophilic hydrocarbyl containing polymeric backbone. Suitable polymers include those wherein the addition polymer contains up to about 5000 units of the formula

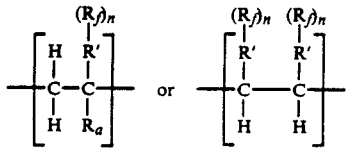

wherein $R_f$, n and R' are defined above, and $R_a$ is hydrogen or lower alkyl. Preferably $R_a$ is hydrogen or methyl.

Such addition polymers are generally prepared, by methods known in the art, e.g. in U.S. Pat. Nos. 3,282,905, 3,491,169 and 4,060,681, by homo- or copolymerizing the corresponding monomer of the formula

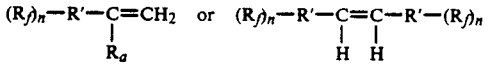

wherein $R_f$, n, R', and $R_a$ are defined above, optionally with polymerizable vinylic comonomers.

Suitable comonomers include:

Ethylene and chloro, fluoro- and cyano- derivatives of ethylene such as vinyl chloride, vinylidene chloride, vinyl fluoride, vinylidene fluoride, acrylonitrile, methacrylonitrile, tetrafluoroethylene, trifluorochloroethylene, hexafluoropropylene; acrylate and methacrylate monomers, particularly those with 1 to 12 or 18 carbon atoms in the ester groups such as n-propyl methacrylate, 2-methyl cyclohexyl methacrylate, methyl methacrylate, t-butyl methacrylate, n-butyl methacrylate, methyl acrylate, ethyl acrylate, propyl acrylate, butyl acrylate, 3-methyl-1-pentyl acrylate, octyl acrylate, tetradecyl acrylate, s-butyl acrylate, 2-ethylhexyl acrylate, 2-methoxyethyl acrylate, and phenyl acrylate; dienes particularly 1,3-butadiene, isoprene, and chloroprene, 2-fluoro-butadiene, 1,1,3-trifluorobutadiene, 1,1,2,3-tetrafluoro butadiene, 1,1,2-trifluoro-3,4-dichlorobutadiene and tri- and pentafluoro butadiene and isoprene; nitrogen-vinyl monomers such as vinyl pyridine, N-vinylimides, amides, vinyl succinimide, vinyl pyrrolidone, N-vinyl carbazole and the like;

styrene and related monomers which copolymerize readily with the novel esters of this invention such as o-methylstyrene, p-methylstyrene, 3,4-dimethyl styrene, 2,4,6-trimethyl styrene, m-ethyl styrene, 2,5-diethyl styrene;

vinyl esters, e.g. vinyl acetate, vinyl esters of substituted acids, such as for example, vinyl methoxyacetate, vinyl trimethylacetate, vinyl isobutyrate, isopropenyl butyrate, vinyl lactate, vinyl caprylate, vinyl pelargonate, vinyl myristate, vinyl oleate and vinyl linoleate; vinyl esters of aromatic acids, such as vinyl benzoate;

alkyl vinyl ethers, such as methyl vinyl ether, isopropyl vinyl ether, isobutyl vinyl ether, 2-methoxy ethyl vinyl ether, n-propyl vinyl ether, t-butyl vinyl ether, isoamyl vinyl ether, n-hexyl vinyl ether, 2-ethylbutyl vinyl ether, diisopropylmethyl vinyl ether, 1-methylheptyl vinyl ether, n-decyl vinyl ether, n-tetradecyl vinyl ether, and n-octadecyl vinyl ether.

Propylene, butylene and isobutylene are preferred α-olefins useful as comonomers with the novel fluoro monomers of the present invention with straight and branched chain α-olefins useful with up to 18 carbon atoms in the side chain.

Suitable candidate compounds of the formula I containing one or more inert stable oleophobic and hydrophobic fluoroaliphatic groups, $R_f$, and an oleophilic hydrocarbyl containing residue, represent a well known class of compounds widely described in the literature.

For example, compounds of the formula I wherein n and m are 1 are described in U.S. Pat. Nos. 4,460,791; 4,302,378; 3,575,899; 3,575,890; 4,202,706; 3,346,612; 3,575,899; 3,989,725; 4,243,658; 4,107,055; 3,993,744; 4,293,441; 4,107,055; and 3,839,343; JP 77/88,592; Ger. Offen. 1,966,931; Ger. Offen. 2,245,722; JP 60/181,141; EP 140,525; JP 53/31582; CH 549,551; EP 74,057; FR 2,530,623; Ger Offen. 2,357,780; JP 58/70806; Ger. Offen. 2,344,889; U.S. Pat. Nos. 3,575,890; and 3,681,329; Ger. Offen. 2,559,189; U.S. Pat. Nos. 3,708,537; 3,838,165; and 3,398,182 Ger. Offen. 2,016,423; Ger. Offen 2,753,095, Ger. Offen. 2,941,473; Ger. Offen. 3,233,830; JP 45/38,759; JP 51/144,730; Ger. Offen. 3,856,616; Ger. Offen. 2,744,044; JP 60/151,378; Ger. Offen. 1,956,198; and GB 1,106,641.

Compounds of the formula I wherein n is 2 or 3, or m is 2 to 4 are described, for example, in U.S. Pat. No. 4,219,625; Ger. Offen. 2,154,574; Ger. Offen. 2,628,776; Text. Res. J., 47 (8), 551-61 (1977); U.S. Pat. Nos. 4,268,598; and 3,828,098; Ger. Offen. 1,938,544; Ger.

Offen. 2,017,399; Ger. Offen. 2,628,776; Ger. Offen. 1,956,198; JP 47/16279; Ger. Offen 1,938,545; Ger. Offen. 1,916,651; U.S. Pat. Nos. 3,492,374; and 4,195,105; Ger. Offen. 2,009,781; U.S. Pat. No. 4,001,305; and GB 1,296,426.

Compounds where n is 1 to 3 and m is in excess of 4, up to for example about 500, are described, inter alia, in U.S. Pat. Nos. 3,935,277; 2,732,370; 2,828,025; 2,592,069; 2,436,144; 4,001,305; 4,046,944; 4,054,592; 4,557,837; 3,282,905 3,491,169; and 4,060,681.

In a preferred embodiment of the invention, highly suitable candidate oil soluble organic compounds, containing at least one oleophobic and hydrophobic group, of formula I useful as antideposition agents in crude oils contaminated with paraffin wax, asphaltenes, or mixtures thereof, contain 1–70% fluorine and have a solubility in crude oil of at least 10 ppm at 80° C. and are advantageously screened for efficacy using simple laboratory techniques as described hereinafter. The compounds of formula I may be used with or without a carrier.

Another preferred embodiment wherein $R_1''$ may be selected from the full range of groups set out above for $R_1$ and $R_1'$ when the $R_f$ groups are selected from perfluoroalkoxy substituted perfluoroalkyl having a total of 4–20 carbon atoms or perfluoroalkenyl of 4–20 carbon atoms.

For example, in screening oil soluble candidate compounds of formula I for paraffin antideposition properties, it has been found that those compounds repeatedly applied to the surface of steel coupons from, e.g., a 5% by weight solution of candidate compound in a suitable volatile inert solvent, such as xylene, toluene, isopropyl acetate, methylene chloride, ethanol, water or miscible mixtures thereof, and air dried after each application, which render the metal coupon sufficiently oleophobic such that hexadecane exhibits a contact angle with the treated coupon of fifteen degrees or more, are characteristically suitable for use in the instant invention.

A second screening technique for oil soluble candidate compounds of formula I for paraffin deposition involves the determination of the comparative deposition reduction in the paraffin contaminated crude oil to be treated by comparing the wax deposition of a treated oil, containing from 10 to 500 parts by weight of the compound of formula I per million parts oil, with a crude oil identical to the treated oil but without the fluorochemical candidate, in respect to the amount of residue retained on the walls of standard laboratory beakers in accordance with the Beaker Method more fully described hereinafter. While 100 ml Pyrex beakers are employed, the test may be run using, e.g. degreased stainless steel 100 ml beakers. Under the test conditions, those compounds in which the treated crude oil composition exhibits reduction in total beaker weight gain due to residual oil on the beaker surface have characteristically been found to be highly preferred.

An alternate and generally efficient laboratory technique for screening preferred oil soluble candidate compounds of formula I for paraffin antideposition properties in the paraffin contaminated crude oil to be treated is the Static Cold Finger Method, described hereinafter. In this test 500 parts by weight of fluorochemical are added per million parts of crude oil. Depending upon the solubility of the fluorochemical under the test conditions, it is recognized that lesser amounts may be employed, to a minimum of about 10 parts by weight of fluorochemical per million parts crude oil, in the event that the candidate possesses but limited solubility. Those treated crude oil compositions exhibiting a reduction in the percent decrease in weight gain of the cold finger coil of at least 10% vis-a-vis crude oil not containing the fluorochemical candidate qualifies such candidate as characteristically suitable for use in the instant invention. Preferred compounds generally inhibit paraffin deposition of crude oils in this method by a percent decrease in weight gain of the coil of at least 20%, most preferably at least 40%.

A convenient laboratory screening technique for oil soluble candidate compounds of formula I for asphaltene deposition inhibition is the Asphaltene Deposition test described hereinafter, wherein a crude oil contaminated with deposition susceptible amounts of asphaltene is treated by dissolving 10 to 200 parts per million by weight of a compound of formula I to such oil and comparing the amount of asphaltene precipitate occasioned by the addition of hexane as compared to an otherwise identical control sample of crude oil not containing the candidate. Preferably, 200 parts per million by weight of candidate compound is employed per part crude oil. It has been found that under the best conditions, those compounds which significantly inhibited the precipitation of asphaltene, e.g. at least 10 percent decrease by weight of asphaltenes collected on the filter paper, preferably at least 20% and most preferably 50%, characteristically result in the compound of highly suitable for use as an asphaltene inhibitor in the instant invention.

It is to be understood that for purposes of easily and efficiently dispersing and dissolving the fluorochemical in the crude oil to be treated, it is generally advantageous to first dissolve or disperse the fluorochemical of formula I in a suitable solvent which is generally compatable with the crude oil in the amounts employed. Suitable solvents vary widely but include, inter alia, conventional organic solvents such as toluene, xylene, cumene, aliphatic and or aromatic oil fractions, petroleum ether, isopropyl acetate, methylene chloride, alkanols and the like.

In the following test descriptions and examples, all temperatures are given in degrees Centigrade and all parts are given in parts by weight unless otherwise indicated. The examples are for illustrative purposes only and are not intended to limit the scope of the invention.

DESCRIPTION OF CRUDE OILS

Crude oil A is paraffinic; originating from Utah, it has a pour point of 31° C., a paraffin content of 22%, and a cloud point of 50° C. Its water content is 0.4%, it is black, and it has API gravity of 35°.

Crude oil B is paraffinic; originating from Utah, it has a pour point of 45° C., a paraffin content of 35%, and a cloud point of 66° C. Its water content is 0.05%, it is yellow and it has an API gravity of 42°.

Crude oil C is paraffinic; originating from Utah, it has a pour point of 35° C., a paraffin content of 25% and a cloud point of 57° C. Its water content is 0.05%, it is black and it has an API gravity of 36°.

Crude oil D is asphaltenic from off shore Italy; it has a viscosity of 39,500 cP at 25° C. Its estimated asphaltene content is 9% and it has an API gravity of 14°.

DESCRIPTION OF LABORATORY TEST METHODS

A. Paraffin Deposition

1. Hexadecane Contact Angles

Degreased steel coupons (SAE 1010 $\frac{1}{2}'' \times 3'' \times \frac{1}{8}''$) are dipped for one minute in a 5% solution of fluorochemical in a suitable solvent, then are removed and air-dried for one minute. The procedure is repeated five times and the coupons are air-dried for at least 30 minutes. Contact angles with hexadecane are determined using a Raume-Hart contact angle goniometer. Hexadecane is used as a testing liquid due to its structural resemblance to paraffin wax and ease of handling. The contact angle of hexadecane with untreated steel coupons is zero degrees; for a fluorochemical to be considered effective the contact angle for the coated coupon should be at least fifteen degrees.

2. Beaker Method

One hundred grams of crude oil are placed in an eight ounce bottle and heated to a temperature 10° C. higher than its cloud point for five minutes. Seven 100 ml beakers are pre-weighed and left standing at room temperature. The crude oil is poured into the first beaker. After the first beaker is filled, its contents are immediately transferred to the second beaker and the first beaker is put upside down. The procedure is repeated five times and the contents of the seventh beaker are transferred to the bottle and the beaker is placed upside down. The total weight gain of the seven beakers is determined. Potential paraffin deposition inhibitors are added to a new sample of oil during the heating stage and the procedure is repeated. Deposition inhibition is expressed as % decrease in beaker weight gain.

3. Static Cold Finger Method

A method similar to the one described by Hunt (*Journal of Petroleum Technology*, 1962, pp 1259–1269) is used: Nine hundred ml of a high paraffin crude oil are placed in a 1 liter vessel and heated with gentle agitation to a temperature 10° C. below its cloud point. A pre-weighed stainless steel coil of 0.25 inch outer diameter and a total surface area of 26 square inches is immersed in the oil for 45 minutes. Water circulating through the coil maintains its temperature 15° C. below the cloud point of the crude oil. The coil is removed and the weight gain due to paraffin deposition is recorded. Potential paraffin deposition inhibitors are added to a new sample of crude oil and the procedure is repeated. Deposition inhibition is expressed as percent decrease in weight gain of the coil.

B. Asphaltene Deposition

As mentioned earlier, addition of low surface tension hydrocarbons depeptizes the asphaltene micelle and causes asphaltene deposition: Fifty grams of low gravity asphaltic crude are mixed with 50 grams of hexane and the mixture is heated at 50° C. with gentle agitation for fifteen minutes. The diluted oil is then filtered through a Whatman #2 filter paper and the asphaltene deposit collected is air dried and weighed. Potential asphaltene deposition inhibitors are added to a new sample of crude oil and the procedure is repeated. Deposition inhibition is expressed as percent decrease of asphaltenes collected on the filter paper.

EXAMPLES 1–10

Hexadecane contact angles for compounds of the formula $$R_f CH_2CH_2SCH_2\underset{\underset{CH_2OH}{|}}{CH}-O\left(CH_2CH_2O\right)_a\left(\underset{\underset{CH_3}{|}}{CH}-CH_2O\right)_b\left(CH_2CH_2O\right)_a H$$ (U.S. Pat. No. 4,310,698)

were determined employing the procedure previously described. Steel coupons were coated using toluene solutions.

| Example # | $R_f$ | a | b | Contact Angle, Degrees[1] |
|---|---|---|---|---|
| 1 | $C_6F_{13}$ | 11 | 16 | 34 ± 1 |
| 2 | 2% $C_4F_9$, 38% $C_6F_{13}$, 35% $C_8F_{17}$ 20% $C_{10}F_{21}$, 5% $C_{12}F_{25}$ | 11 | 16 | 40 ± 1 |
| 3 | $C_6F_{13}$ | 6 | 56 | 25 ± 1 |
| 4 | 2% $C_4F_9$, 38% $C_6F_{13}$, 35% $C_8F_{17}$ 20% $C_{10}F_{21}$, 5% $C_{12}F_{25}$ | 6 | 56 | 25 ± 1 |
| 5 | $C_6F_{13}$ | 5 | 21 | 32 ± 1 |
| 6 | $C_6F_{13}$ | 12 | 21 | 33 ± 1 |
| 7 | $C_6F_{13}$ | 3 | 30 | 25 ± 1 |
| 8 | $C_6F_{13}$ | 10 | 30 | 31 ± 1 |
| 9 | $C_6F_{13}$ | 5 | 39 | 25 ± 1 |
| 10 | $C_6F_{13}$ | 22 | 39 | 39 ± 1 |

[1]Average of at least four measurements.

All contact angles are greater than fifteen degrees indicating that the tested compounds are useful as deposition inhibitors. Since many of the above compounds are soluble in hexadecane the angle may decrease as the coating dissolves in hexadecane; therefore only initial angles should be considered.

EXAMPLES 11–13

Hexadecane contact angles were determined for some commercial fluorochemicals. Steel coupons were coated using toluene solutions.

| Example # | Trade Name, Source | Contact Angle, Degrees[1] |
|---|---|---|
| 11 | Fluorad ® FC 430, 3M Co.[3] | 40 ± 1 |
| 12 | Fluorad ® FC 740, 3M Co.[3] | 45 ± 3[2] |
| 13 | Fluorad ® FC 742, 3M Co.[3] | 64 ± 2 |

[1]Average of at least four measurements.
[2]The angle rapidly decreases to about 20 degrees.
[3]Listed as fluorinated alkyl esters.

The above contact angles indicate that the compounds of the examples are useful as paraffin deposition inhibitors. The rapid contact angle decrease (from 45° to 20°) for the FC 740 coated coupon is attributed to the dissolution of FC 740 in hexadecane.

EXAMPLES 14–21

The efficiency of compounds of the formula $$C_6F_{13}CH_2CH_2SCH_2\underset{\underset{CH_2OH}{|}}{CH}-O\left(CH_2CH_2O\right)_a\left(\underset{\underset{CH_3}{|}}{CH}-CH_2-O\right)_b\left(CH_2CH_2O\right)_a H$$

as paraffin deposition inhibitors was determined by the previously described static cold finger method.

Crude A was used and it was held at 40° C. The water circulating through the coil was at 35° C. and treating level of inhibitor in crude oil was 500 ppm.

| Example # | a | b | % Inhibition |
|---|---|---|---|
| 14 | 5 | 21 | 79 |
| 15 | 11 | 21 | 65 |
| 16 | 3 | 30 | 77 |
| 17 | 10 | 30 | 37 |
| 18 | 5 | 39 | 65 |
| 19 | 22 | 39 | 25 |
| 20 | 6 | 56 | 65 |
| 21 | 19 | 30 | 76 |

The above examples demonstrate dramatic decreases in paraffin deposition. It should be noted that this is a static evaluation and even greater decreases may be observed in a dynamic system where precipitated paraffins are carried by the flowing crude oil.

EXAMPLE 22

A mixture of 1.58 g benzotriazole (0.0131 mole), 7.0 g $$C_8F_{17}CH_2CH_2SCH_2CH_2CH_2OCH_2\overset{O}{\overset{/\backslash}{CH}}-CH_2$$

(0.0114 mole) and 34.24 g toluene, is heated to reflux (110°-111° C.) for 10.25 hours. Then 0.02 g boron trifluoride etherate are added and the reaction mixture is heated under reflux for 45 minutes. Removal of the toluene affords a product containing a mix of two isomers with the following structures I and II, as determined by $^{13}$C-NMR:

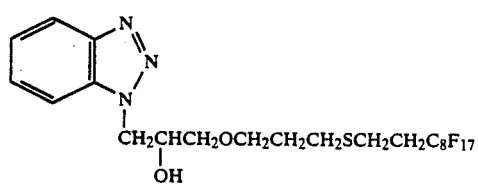

(I)

and

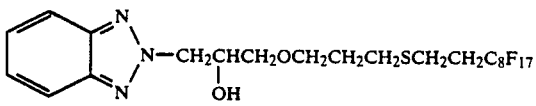

(II)

Analysis: Calculated (percent): C, 37.0; H, 2.8; N, 6.7; F, 45.3; Found (percent): C, 37.3; H, 2.8; N, 6.7; F, 43.6.

EXAMPLE 23

A mixture of 26.8 g (0.05 moles) of 3-(1,1,2,2-tetrahydroperflurordecanethio)-1,2-epoxypropane was reacted with 14.9 g (0.05 moles) of octadecyldimethylamine and 3.35 g (0.055 moles) of acetic acid in 179 grams toluene at 50°-60° for 18 hours.

The clear reaction product has the structure $$C_8F_{17}CH_2CH_2SCH_2CH(OH)CH_2\overset{+}{N}(CH_3)_2C_{18}H_{37}O_2{}^-CCH_3$$

and is soluble at a 20% concentration in toluene to 0° C.

The product was coated on a coupon of cold rolled mild steel SAE 1010 and contact angle measurements were run. For hexadecane the angle was 50° (untreated steel=0°, i.e. it wets completely). Its surface tension in toluene at 1% was 26.0 dynes/cm (toluene=28.2).

EXAMPLE 24

A 300 ml, 3-neck reaction flask equipped with stirrer, nitrogen inlet, condenser and thermometer was charged with 30 g (0.03 mol) ($R_f$)$_2$-diol* and 35 g methylethyl ketone (MEK) which had been dried over molecular sieves. After all diol had dissolved, 4.4 g, 3,3,4-trimethyl hexane-1,6-diisocyanate (TMDI) (0.02 mol) were added followed by 0.01 g triethylamine. The mixture was heated to reflux for three hours, after which time free —NCO groups were not detected by IR. Then another 4.4 g TMDI were added, dissolved in 4.4 g MEK followed after ½ hour by 4.5 g bis-2-aminopropyl ether of polyethylene glycol of MW 900 (BAPG-900) (0.05 mol) and 8.8 g TMDI together with 54 g MEK. The mixture was kept at reflux for 4 more hours at which time no —NCO was detectable by IR. Heating was discontinued at 90 g water were slowly added under vigorous stirring. A yellowish, slightly turbid solution resulted, whose solids content was adjusted to 25%.

* The diol has the formula $$\begin{array}{l} R_fCH_2CH_2SCHCH_2OH \\ \quad\quad\quad\quad\ \ | \\ R_fCH_2CH_2SCHCH_2OH \end{array}$$

where $R_f$ is a mixture of perfluoroalkyl chains consisting of $C_6F_{13}$, $C_8F_{17}$ and $C_{10}F_{21}$ (U.S. Pat. No. 4,001,305).

EXAMPLE 25

Methyl ethyl ketone (600 g) was charged to a 2 l flask fitted with a stirrer, thermometer, nitrogen inlet and a condenser protected with a drying tube. 2,3-Bis(1,1,2,2-tetrahydroperfluoroalkylthio) butane-1,4-diol (600 g; 0.571 mole)* was added together with a 1:1 mixture of 2,2,4-trimethylhexamethylene diisocyanate and 2,4,4-trimethylhexamethylenediisosycanate (80.16 g; 0.381 mole). All reagents were rinsed in with an additional 50 g MEK. The solution was heated to boiling and 50 g solvent was removed by distillation to effect azeotropic drying of all materials. Then dibutyltindilaurate (0.692 g; $1.4\times10^{-3}$ mole; 2 mole % based on diol) was added as a catalyst and the solution was heated under reflux for 6 hours, when the reaction was judged to be complete by the absence of the N=C=O infrared band at 2270 cm$^{-1}$. The solution was cooled to room temperature (25°) and diluted with MEK to a total of 2042 g (33⅓% solids). A portion of the above material was taken to dryness. A quantitative recovery of a resinous material was obtained. Elemental analysis showed 52.8% F (theory: 53.4% F). Infrared bannds at 3460 cm$^{-1}$ (O—H str.), 3340 cm$^{-1}$ (N—H str.) and 1705

$cm^{-1}$ (C=)str.) confirmed the structure of the hydroxy-terminated urethane prepolymer.

* The diol has the formula $$\begin{array}{l} R_fCH_2CH_2SCHCH_2OH \\ \quad\quad\quad\quad\quad\quad | \\ R_fCH_2CH_2SCHCH_2OH \end{array}$$

where $R_f$ is a mixture of perfluoroalkyl chains consisting of $C_6F_{13}$, $C_8F_{17}$ and $C_{10}F_{21}$ (U.S. Pat. No. 4,001,305).

The hydroxy-terminated prepolymer (53.7 g solution, 17.9 g solids) was treated further at 75° with dimer acid derived diisocyanate (6.0 g; 0.01 mole) (DDI, HENKEL Company) for two hours, then the urethane chain was completed by the addition of trimethylhexamethylene diisocyanate (2,2,4 and 2,4,4 isomer mixture) (1.05 g; 0.005 mole) and N-methyldiethanolamine (1.19 g; 0.01 mole). Reaction was complete in three hours, as shown by the disappearance of the N=C=O band (2270 $cm^{-1}$) in the infrared spectrum. Hexadecane contact angle on steel coupons was 73±1 degrees.

EXAMPLES 26–29

The efficiency of the compounds whose preparation is described in examples 22–25 as paraffin deposition inhibitors was determined by the previously described static cold finger method. Crude A was used and it was held at 40° C. The water circulating through the coil was at 35° C. and treating level of inhibitor in crude oil was 500 ppm.

| Example # | Compound Described in Example | % Inhibition |
|---|---|---|
| 26 | 22 | 65 |
| 27 | 23 | 76 |
| 28 | 24 | 76 |
| 29 | 25 | 51 |

EXAMPLES 30–33

Potential paraffin deposition inhibitors were evaluated using the previously described beaker method. Testing levels of inhibitor in crude oil were 500 ppm.

| Example # | Inhibitor | Crude Oil | % Inhibition |
|---|---|---|---|
| 30 | Compound F[1] | C | 9.7 |
| 31 | Compound G[2] | C | 19.4 |
| 32 | Compound G | B | 4.1 |
| 33 | Fluorad ® FC 740 | B | 3.2 |

[1]Compound F:

$$C_6F_{13}CH_2CH_2SCH_2\underset{\underset{CH_2OH}{|}}{CH}-O(CH_2CH_2-O)_6(\underset{\underset{CH_3}{|}}{CHCH_2}-O-)_{56}(CH_2CH_2O)_6H$$

[2]Compound G:

$$C_6F_{13}CH_2CH_2SCH_2\underset{\underset{CH_2OH}{|}}{CH}-O(CH_2CH_2O)_5(\underset{\underset{CH_3}{|}}{CHCH_2}-O)_{21}(CH_2CH_2O)_5H$$

A comparison of example 30 with example 20 reveals that although 65% inhibition was recorded by the coil method, the beaker method yielded only 9.7% inhibition for the same compound. This is an indication of the severity of the beaker method and any inhibition recorded using this method is an indication of the usefulness for a compound.

EXAMPLES 34–54

Based on the use of the previously described evaluation methods the following fluorochemicals exhibit usefulness as steam injection additives.

| Example # | Reference and Fluorochemical |
|---|---|
| 34 | Ger. Offen. DE 2245722<br>$F_3C(CF_2)_7(CH_2)_2S(CH_2)_{11}OH$ |
| 35 | Jpn. Kokai Tokkyo Kono JP 60/1811<br>$CH_3(CH_2)_{16}C(O)O(CH_2)_2(CF_2)_7CF_3$ |
| 36 | Eur. Pat. Appl. EP 140525<br>$CH_3(CH_2)_3(CH{=}CH)_3(CH_2)_7C(O)O(CH_2)_2N(CH_3)SO_2(CF_2)_7CF_3$ |
| 37 | U.S. Pat. No. 3,989,725<br> 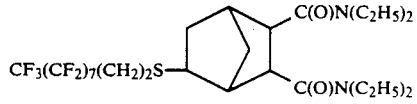 |
| 38 | Ger. Offen. DE 2357780<br>$CF_3(CF_2)_7CH(OH)CH_2NH(CH_2)_7CH_3$ |
| 39 | U.S. Pat. No. 4,202,706<br>$CF_3(CF_2)_7SO_2N(C_2H_5)(CH_2)_{11}OH$ |
| 40 | Jpn. Kokai Tokkyo Koho JP 60/15137<br> 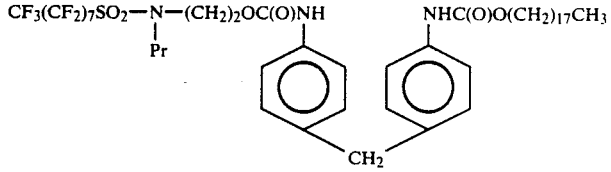 |
| 41 | Ger. Offen. DE 3,306,593<br>Poly[oxy(methyl-1,2-ethanediyl)],<br>α-(3,3,4,4,5,5,6,6,7,7,8,8,9,9,10,10,10-heptadecafluorodecyl)-ω-hydroxy-(9CI) |
| 42 | Fr. FR 2,117,416<br>Poly[oxy(methyl-1,2-ethanediyl)],<br>α-[2-[ethyl[(heptadecafluorooctyl)sulfonyl]-amino]methylethyl]-ω-hydroxy-(9CI) |

-continued

| Example # | Reference and Fluorochemical |
|---|---|
| 43 | J. Econ. Entomol., 78(6), 1190–7<br>$H\text{-}[O(CH_2)_3]_8\text{-}O(CH_2)_2N(CH_2)_3CH_3)SO_2(CF_2)_7CF_3$ |
| 44 | Eur. Pat. Appl. EP 144,844<br>$^{\ominus}O_3S(CH_2)_2\text{-}N^{\oplus}(CH_3)_2\text{-}[CH_2CH(CH_3)O]_3\text{-}CH_2CH(CH_3)\text{-}NH(CH_2)_2(CH_2)_7CF_3$ |
| 45 | Japan Kokai JP 53/31582<br>$CH_3(CH_2)_{16}C(O)(OCH_2CH_2)_5N(CH_3)SO_2(CF_2)_7CF_3$ |
| 50 | Jpn. Kokai Tokkyo Koho JP 58/70806<br>$CH_3(CH_2)_{17}CONH(CH_2)_6NHSO_2(CF_2)_7CF_7$ |
| 51 | U.S. patent application Ser. No. 455,727<br> 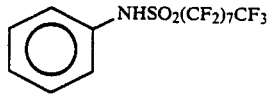 <br>$NHSO_2(CF_2)_7CF_3$ |
| 52 | U.S. Pat. No. 3,575,899<br> 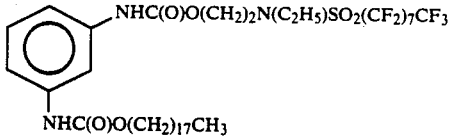 <br>$NHC(O)O(CH_2)_2N(C_2H_5)SO_2(CF_2)_7CF_3$<br>$NHC(O)O(CH_2)_{17}CH_3$ |
| 53 | Japan Kokai JP 51/144730<br>$NHC(O)O(CH_2)_3O(CH_2)_2(CF_2)_7CF_3$<br> 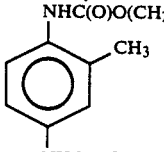 <br>$CH_3$<br>$NHC(O)[OCH_2CH_2]_7OH$ |
| 54 | Japan Kokai JP 51/151126<br>Poly[oxy(methyl-1,2-ethanediyl)],<br>ω-[(3,3,4,4,5,5,6,6,7,7,8,8,9,9,10,10,10-heptadecafluorodecyl)oxy]-ω'-hydroxy-<br>α,α'-[(methyl-phenylene)bis(iminocarbonyl)]bis-(9CI) |

EXAMPLES 55–74

The fluorinated addition polymers described in the following examples exhibit usefulness as paraffin deposition inhibitors. Addition of 1% dodecyl mercaptan to the monomer mixture yields polymers having low enough molecular weight to be oil soluble.

| Example | $R_f$ Monomer | Parts | Comonomer | Parts |
|---|---|---|---|---|
| 55 | $C_8F_{17}SO_2N(CH_3)CH_2CH_2OOCCH{=}CH_2$ | 80 | Octadecyl acrylate | 20 |
| 56 | $C_6F_{13}C_2H_4OOCC(CH_3){=}CH_2$ | 65 | Tridecyl methacrylate | 35 |
| 57 | $C_6F_{13}C_2H_4SC_2H_4OOCCH{=}CH_2$ | 70 | $CH_2{=}CHCOO(CH_2CH_2O)_6(CH(CH_3)CH_2O)_{56}(CH_2CH_2O)_6\text{—}H$ | 30 |
| 58 | $C_8F_{17}C_2H_4OOCC(CH_3){=}CH_2$ | 40 | Decyl methacrylate | 60 |
| 59 | $C_8F_{17}C_2H_4N(CH_3)C_2H_4OOCC(CH_3){=}CH_2$ | 45 | 3,5,5-Trimethylhexyl methacrylate | 55 |
| 60 | $C_2F_5C_6F_{10}CH_2OOCCH{=}CH_2$ | 60 | $C_{22}H_{45}OOC(CH_3){=}CH_2$ | 40 |
| 61 | $C_7F_{15}CH_2OOCCH{=}CH_2$ | 90 | Decyl acrylate | 10 |
| 62 | $C_7F_{15}CON(CH_3)C_2H_4OOCCH{=}CH_2$ | 50 | Lauryl methacrylate | 50 |
| 63 | $(CF_3)_2CF(CF_2)_6CH_2CH(OH)CH_2OOCCH_2CH_2{=}CH_2$ | 60 | 2,6,8-Trimethyl-4-nonyl methacrylate | 40 |
| 64 | $(CF_3)_2CFOC_2F_4C_2H_4OOCCH{=}CH_2$ | 35 | Lauryl acrylate | 65 |
| 65 | $C_8F_{17}C_2H_4SO_2N(C_3H_7)C_2H_4OOCCH{=}CH_2$ | 70 | Tridecyl acrylate | 30 |
| 66 | $C_7F_{15}C_2H_4CONHC_4H_8OOCCH{=}CH_2$ | 50 | Stearyl methacrylate | 50 |
| 67 | $C_3F_7(CF(CF_3)CF_2O)_2CF(CF_3)CH_2OOCCH{=}CH_2$ | 80 | Stearyl acrylate | 20 |
| 68 | $C_7F_{15}COOCH_2C(CH_3)_2CH_2OOCC(CH_3){=}CH_2$ | 75 | Octadecyl acrylate | 25 |

-continued

| Example | $R_f$ Monomer | Parts | Comonomer | Parts |
|---|---|---|---|---|
| 69 | $C_8F_{17}SO_2N(C_2H_5)C_4H_8OOCCH{=}CH_2$ | 10 | Lauryl methacrylate | 90 |
| 70 | $(C_3F_7)_2C_6H_3SO_2N(CH_3)C_2H_4OOCCH{=}CH_2$ | 60 | 2,6,8-trimethyl-4-nonyl methacrylate | 40 |
| 71 | 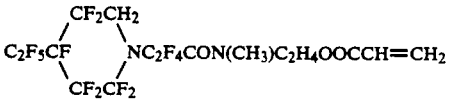 | 40 | Decyl methacrylate | 60 |
| 72 | $C_6F_{17}CF{=}CHCH_2N(CH_3)C_2H_4OOCCH{=}CH_2$ | 50 | $C_{22}H_{45}OOC(CH_3){=}CH_2$ | 50 |
| 73 | $C_8F_{17}SO_2N(C_4H_9)C_2H_4OCOCH{=}CH_2$ | 35 | Stearyl acrylate | 65 |
| 74 | $C_8F_{17}SO_2N(C_2H_5)C_2H_4OCOCH(CH_3){=}CH_2$ | 50 | Tridecyl methacrylate | 50 |

In the foregoing Examples 55–74, the monomers and dodecyl mercaptan are dissolved in tetrahydrofuran, an azo initiator, azo-bis (isobutrylnitrile), is added in an amount of about 0.1% by weight based on the amount of monomer, and the solutions are placed in ampules which are evacuated and sealed, and the polymerization conducted at 100° C. overnight in an agitating bath.

WHAT IS CLAIMED IS:

1. A method of inhibiting deposition of paraffin wax, asphaltene, or mixtures thereof in a crude oil contaminated therewith and susceptible to such deposition comprising incorporating into said crude oil an effective deposition inhibiting amount of an oil soluble organic compound of the formula $$[(R_f)_nR']_mZ \qquad \text{(I)}$$

wherein n is an integer of from 1 to 3;

m is an integer of from 1–5000;

$R_f$ is a perfluoro alkoxy substituted perfluoro alkyl having a total of 4–20 carbon atoms or perfluoroalkenyl of 4–20 carbon atoms R′ is a direct bond or an organic linking group having a valency of n+1 and is covalently bonded to both $R_f$ and Z; and Z is a hydrocarbyl containing residue having a valency of m and being sufficiently oleophilic so as to impart an oil solubility to said compounds of at least 10 parts per million by weight of said asphaltenic crude oil.

2. The method of claim 1 wherein $R_f$ is perfluoroalkenyl having 4–20 carbon atoms.

3. A method of inhibiting deposition of paraffin wax, asphaltene, or mixtures thereof in a crude oil contaminated therewith and susceptible to such deposition comprising incorporating into said crude oil an effective deposition inhibiting amount of an oil soluble organic compound of the formula $$[(R_f)_nR']_mZ \qquad \text{(I)}$$

wherein n is an integer of 1–3;

m is an integer of 1–5000;

$R_f$ is an inert, stable, oleophobic and hydrophobic fluoroaliphatic group having about 4 to about 20 carbon atoms;

R′ is a direct bond or an organic linking group having a valency of n+1 and is covalently bonded to both $R_f$ and Z, and a) when n is 1 R′ is selected from (i) —$C_1$–$C_8$ alkylene—, —phenylene—, —$C_1$–$C_8$alkylene— $R_1$–$C_{1-8}$alkylene—, —$C_3$–$C_8$ alkylene—$R_1$—, —$C_{1-2}$alkylene—$R_1$″—$R_1$–$C_{1-8}$alkylene, —$R_1$–$C_{1-8}$alkylene—$R_1$′—, —$R_1$—, —$R_1$—phenylene—, —$R_1$—phenylene—$R_1$′—, —$R_1$—phenylene—$C_{1-8}$ alkylene, and -phenylene-$R_1$- wherein in each case, said alkylene is straight, or branched, or cyclic and in each case said alkylene and phenylene are independently unsubstituted or substituted by hydroxy, halo, nitro, carboxy, $C_{1-6}$ alkoxy, amino, $C_{1-6}$ alkanoyloxy, or $C_{1-6}$ alkanoylamino and said $R_1$ and $R_1$′- are each independently selected from —$NR_2$—, —CO—, —$N(R_2)CO$—, —$CON(R_2)$—, —$N(R_2)COO$—, —$OOCN(R_2)$—, —S—, —SO—, —$SO_2$—, —$N(R_2)SO_2$—, —$SO_2N(R_2)$—, —$N(R_2)CON(R_2)$—, —COO—, —OOC—, —$SO_2O$—, —$OSO_2$—, —$OSO_2O$—, $$-OCOO-,\ -\overset{\overset{O}{\|}}{\underset{\underset{OR_2}{|}}{O}P}-,\ -\overset{\overset{O}{\|}}{\underset{\underset{OR_2}{|}}{P}}-O-,\ -\overset{\overset{O}{\|}}{\underset{\underset{OR_2}{|}}{P}}-,\ \text{and}\ -O-;$$

and $R_1\Delta$ is selected from —$NR_2$—, —CO—, —$N(R_2)CO$—, —$CON(R_2)$—, —$NR_2COO$—, —$OOCN(R_2)$—, —S—, —SO—, —$SO_2$—, —$N(R_2)SO_2$—, —$SO_2N(R_2)$—, —$N(R_2)CON(R_2)$—, —COO—, —$SO_2O$—, —$OSO_2$—, —$OSO_2O$—, —OCOO—, $$-\overset{\overset{O}{\|}}{\underset{\underset{OR_2}{|}}{P}}-O-,\ -O-\overset{\overset{O}{\|}}{\underset{\underset{OR_2}{|}}{P}}-,\ -\overset{\overset{O}{\|}}{\underset{\underset{OR_2}{|}}{P}}-,\ \text{and}\ -O-,$$

and $R_2$ is H, $C_{1-6}$ alkyl which is unsubstituted or substituted by $C_{1-6}$ alkoxy, halo, hydroxy, carboxy, $C_{1-6}$ carbalkoxy, $C_{1-6}$ alkanoylamino, or $C_{1-6}$ alkanoyloxy; or the nitrogen to which $R_2$ is attached is quaternized by further being bound to $R_3$ which $R_3$ is H, $C_{1-6}$ alkyl, hydroxy-$C_{1-6}$ alkyl, $C_{1-6}$ alkoxy, $C_{1-6}$ alkanoyloxy, or $C_{1-6}$ carbalkoxy, the charge of the quaternized nitrogen being balanced by an anion; and (ii) an ionically bridged group of the formulae $$-(R_a')_s\,Q^{\oplus\ominus}T\,(R_b')_t \qquad \text{(II)}$$

or $$-(R_a')_s\,T^{\ominus\oplus}Q\,(R_b')_t \qquad \text{(III)}$$

wherein $R_a'$ is —$C_{1-8}$ alkylene—, —phenylene—, —$C_{3-8}$ alkylene —$R_1$—$C_{1-8}$ alkylene—, —$R_1$—$C_{3-8}$ alkylene—, —$R_1$—phenylene—, or —$R_1$—phenylene—$C_{1-8}$ alkylene—;

$R_b'$ is —$C_{1-8}$ alkylene—, —phenylene—, —$C_{1-8}$ alkylene —$R_1$—$C_{1-8}$ alkylene—, —$C_{1-8}$ alkylene—$R_1$—, —phenylene—$R_1$—, or —$C_{1-8}$ alkylene—phenylene—$R_1$—;

s and t are each independently zero or 1; and within said $R_a'$ and $R_b'$, said alkylene and phenylene groups are unsubstituted or substituted by hydroxy, halo, nitro, carboxy, $C_{1-6}$ alkoxy, amino, $C_{1-6}$ alkanoyl, $C_{1-6}$ carbalkoxy, $C_{1-6}$ alkanoyloxy, or $C_{1-6}$ alkanoylamino;

T is a phenolic hydroxy residue, carboxy, a sulfoxy, a sulfato, or a phosphono group; and Q is —$N(R_2)_2R_3$;

(b) when n is 2, R' is selected from the trivalent analogs of the groups within (a) above and further selected from

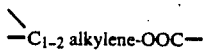

which is unsubstituted or substituted by hydroxy, halo, nitro, carboxy, $C_{1-6}$ alkoxy, amino, $C_{1-6}$ alkanoyl, $C_{1-6}$ carbalkoxy, $C_{1-6}$ alkanoyloxy, or $C_{1-6}$ alkanoylamino and still further selected from radicals of the formula

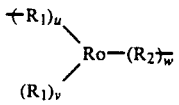

(IV)

where u, v, and w are independently 0 or 1 and $R_0$ is alkanetriyl, arenetriyl, or aralkanetriyl, each having up to 18 carbon atoms and each being uninterrupted or interrupted by —O—, —S—, or —N($R_2$)—;

and (c) when n is 3, R' is selected from the tetravalent analogs of the groups within (b) above;

and Z is a hydrocarbyl containing residue having a valency of n and is sufficiently oleophilic so as to impart an oil solubility to said compounds of at least 10 parts per million by weight of said asphaltenic crude oil.

4. The method of claim 3 wherein $R_1$ and $R_1'$ are selected from the same group as $R_1''$ when n is 1.

5. The method of claim 4 wherein $R_1$ and $R_1'$ are selected from the same group as $R_1''$.

6. The method of claim 5 wherein $R_1''$ is selected from —$NR_2$—, —S—, —$SO_2$—, —$N(R_2)SO_2$—, —$SO_2N(R_2)$—, —$SO_2O$—, —$OSO_2$—, —$OSO_2O$—,

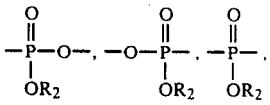

and

—O— wherein the N atom may also be quaternized by being further bound to $R_3$.

* * * * *